US006795990B1

(12) United States Patent
Hutchinson D. C.

(10) Patent No.: US 6,795,990 B1
(45) Date of Patent: Sep. 28, 2004

(54) THERAPEUTIC PILLOW COMBINATION

(76) Inventor: Jason Hutchinson D. C., 1304 Kenton Way, Troy, OH (US) 45373

( * ) Notice: Subject to any disclaimer, the term of this patent is extended or adjusted under 35 U.S.C. 154(b) by 0 days.

(21) Appl. No.: 10/601,394

(22) Filed: Jun. 23, 2003

(51) Int. Cl.[7] ..... A47C 20/00

(52) U.S. Cl. ..... 5/632; 5/630; 5/648; 5/652; 5/657; 5/490

(58) Field of Search ..... 5/630, 632, 633, 5/640, 645, 652, 657, 648, 490, 491, 922

(56) References Cited

U.S. PATENT DOCUMENTS

| | | | | | |
|---|---|---|---|---|---|
| 941,043 | A | * | 11/1909 | Powell | 5/640 |
| D257,200 | S | * | 10/1980 | LaRocca | D6/601 |
| 4,506,396 | A | | 3/1985 | Ritchie, Jr. et al. | |
| 4,528,981 | A | * | 7/1985 | Behar | 5/637 |
| 4,576,150 | A | * | 3/1986 | Auracher | 602/18 |
| 4,794,657 | A | * | 1/1989 | Avery | 5/632 |
| 4,876,755 | A | * | 10/1989 | Parrish | 297/284.3 |
| 5,182,828 | A | | 2/1993 | Alivizatos | |
| 5,269,323 | A | | 12/1993 | Krouskop | |
| 5,418,991 | A | | 5/1995 | Shiflett | |
| 5,499,418 | A | | 3/1996 | Tan et al. | |
| 5,572,757 | A | | 11/1996 | O'Sullivan | |
| 5,581,832 | A | | 12/1996 | Bridley | |
| 5,878,453 | A | * | 3/1999 | Stokes | 5/648 |
| 6,052,848 | A | * | 4/2000 | Kelly | 5/632 |

* cited by examiner

*Primary Examiner*—Michael F. Trettel
(74) *Attorney, Agent, or Firm*—R. William Graham

(57) ABSTRACT

A therapeutic pillow combination includes first and second pillow inserts, wherein the inserts are interconnected using a pillow case having a two ends shaped to removably receive and retain each pillow through a closable end portion, wherein the ends are connected by a gathered and seamed portion which forms a handle therebetween. Another pillow insert is removably connected to the gathered handle portion by way of a strap portion having a hook and loop fastener which is connected to one end of a pillow case to contain the third pillow insert.

7 Claims, 3 Drawing Sheets

Fig. 7
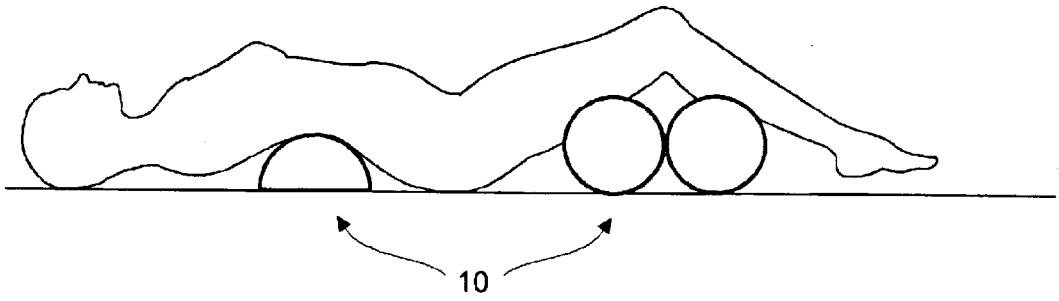
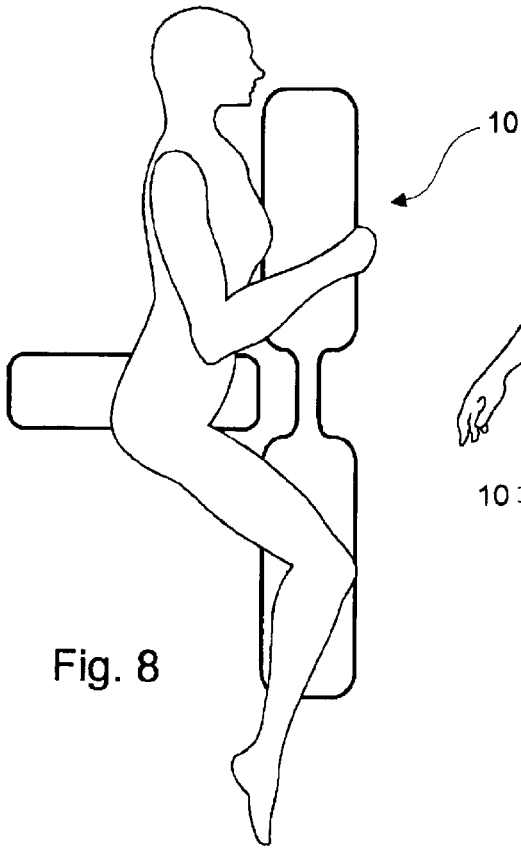
Fig. 8
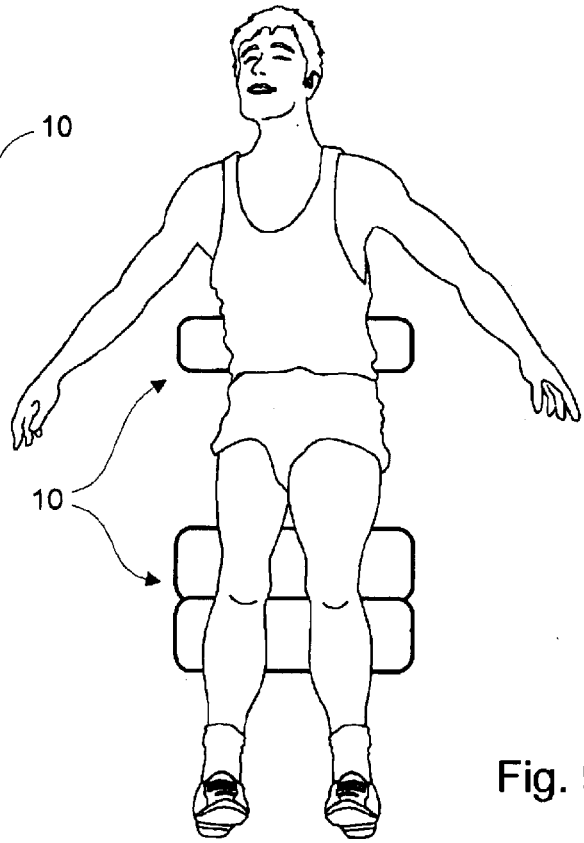
Fig. 9

THERAPEUTIC PILLOW COMBINATION

BACKGROUND OF THE INVENTION

1. Field of the Invention

The present invention relates to a therapeutic pillow combination for use by a person with lower back pain, a pregnant woman, and/or a nursing mother, for example. More particularly, the invention relates to a therapeutic pillow combination which includes two pillows which are interconnected using a pillow case having a two ends shaped to removably receive each pillow, wherein the pillow case ends are connected by a gathered and seamed intermediate portion of the pillow case to form a handle therebetween and further includes a third pillow within another pillow case which is connected to the gathered portion by way of a strap portion having a hook and loop fastener to removably connect about the handle.

2. Description of the Related Art

Various therapeutic and/or orthopedic pillows have been developed to provide support to a person's neck and/or lower back. U.S. Pat. No. 5,572,757 to O'Sullivan, for example, discloses therapeutic pillow combination which includes a first cushion and a second cushion. The first cushion has a substantially semicylindrical shape defined by a semicylindrical top surface, two substantially semicircular end surfaces, and a substantially rectangular bottom surface having first and second long sides and two short sides. The second cushion has a substantially semicylindrical shape defined by a semicylindrical top surface, two substantially semicircular end surfaces, and a substantially rectangular bottom surface having first and second long sides and two short sides. The first long side of the second cushion is positioned substantially parallel to and hingedly connected to the second long side of the first cushion so that the first and second cushions can be rotated with respect to each other.

U.S. Pat. Nos. 5,499,418 and 5,581,832 also show cylindrical or hemi-cylindrical pillow supports. Further, U.S. Pat. Nos. 5,499,418, 5,581,832, 5,182,828, 4,624,021, 4,506,396, 5,418,991, 5,260,323, and 5,664,271 show and describe various pillows and therapeutic supports. U.S. Pat. No. 4,506,396 shows a pair of pillows which are connectable by hook and loop fasteners and has handles sewn directly onto each pillow.

While conventional support devices exist which provide various functional features, there remains a need for an improved therapeutic pillow combination that serves functional objectives as well as aesthetic objectives of the user.

SUMMARY OF THE INVENTION

It is an object to improve therapeutic pillows.

It is another object to provide a multifunctional therapeutic pillow combination.

It is another object to provide an aesthetically pleasing therapeutic pillow combination.

It is another object to provide a pillow for posture friendly sleeping on one's side, back or stomach.

It is yet another object to provide a pillow which in its folded state provides a highly suitable back support for a nursing mother.

Accordingly, the present invention is directed to a therapeutic pillow combination. The combination includes first and second pillow inserts, each preferably elongated having a rounded side portion, wherein the inserts are interconnected using a pillow case having a two ends shaped to removably receive and retain each pillow through a closable end portion, wherein the ends are connected by a gathered and seamed portion which forms a handle therebetween. The interconnected pillow inserts can be aligned in a collinear manner at 180 degrees or articulated to a side by side parallel position. In addition, another pillow insert is removably connected to the gathered handle portion by way of a strap portion having a hook and loop fastener which is connected to one end of a pillow case to contain the third pillow insert. The third pillow insert also is preferably elongated and has a rounded side portion. The pillow cases are configured with overlapping end portions having complementary hook and loop fasteners to permit insertion and retention of the respective pillow insert therein. When the pillow inserts are within the pillow cases, respective pillows are formed.

In one configuration, the pillows so connected form a T-shape, wherein the first pillow serves as an arm support for a person lying on one's side, while the second pillow serves to support between the legs and the third pillow is generally perpendicular to the first and second pillows and serves as a support under the waist lumbar area. In another configuration, the pillows are connected to be in a side by side parallel form, with the handle forming a connecting point for all pillows wherein the pillows can be stacked and disposed against a corner surface support having a generally triangular side profile to serve as a back support for a person. The pillows are spatially connected in a manner such that they can be used for leg, back arm or stomach support, yet easily transported by one hand with grasp of the gathered handle portion. Further, the stacked pillows provide an aesthetically pleasing pillow arrangement which can be used on one's bed without appearing awkward or overbearing in association with other sleeping and or ornamental pillows used thereon.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

FIG. 7 is a side views which illustrates yet another use of the therapeutic pillow combination shown in FIG. 1.

FIG. 8 is a top view which illustrates a use of the therapeutic pillow combination shown in FIG. 1.

FIG. 9 is another top view which illustrates a use of the therapeutic pillow combination shown in FIG. 1.

DETAILED DESCRIPTION OF THE PREFERRED EMBODIMENTS

Figure 1:
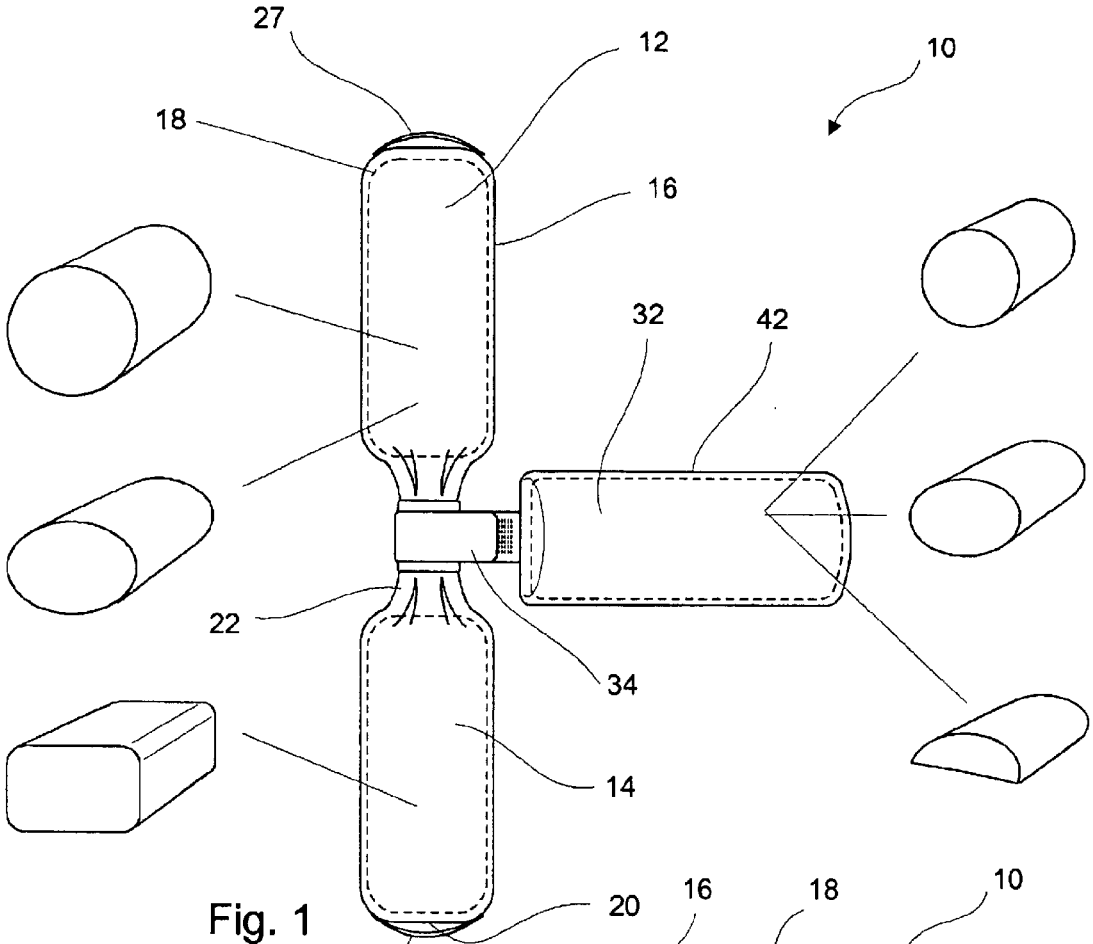
FIG. 1 is a perspective view which illustrates one embodiment of a therapeutic pillow combination in accordance with the present invention, wherein alternative pillow insert shapes are shown for use in parts thereof.

Referring now to the drawings, the therapeutic pillow combination in accordance with the present invention is generally referred to by the numeral 10. The therapeutic pillow combination 10 includes first pillow insert 12 and second pillow insert 14, each preferably elongated having a rounded side portion. As seen in FIG. 1, the inserts 12 and 14 can preferably take on a shape of generally cylindrical, generally oval cylindrical or generally rectangular having rounded corners and edges. The inserts 12 and 14 are interconnected using a pillow case 16 having a two ends 18 and 20, respectively shaped to removably receive each pillow insert 12 and 14.

Figure 2:
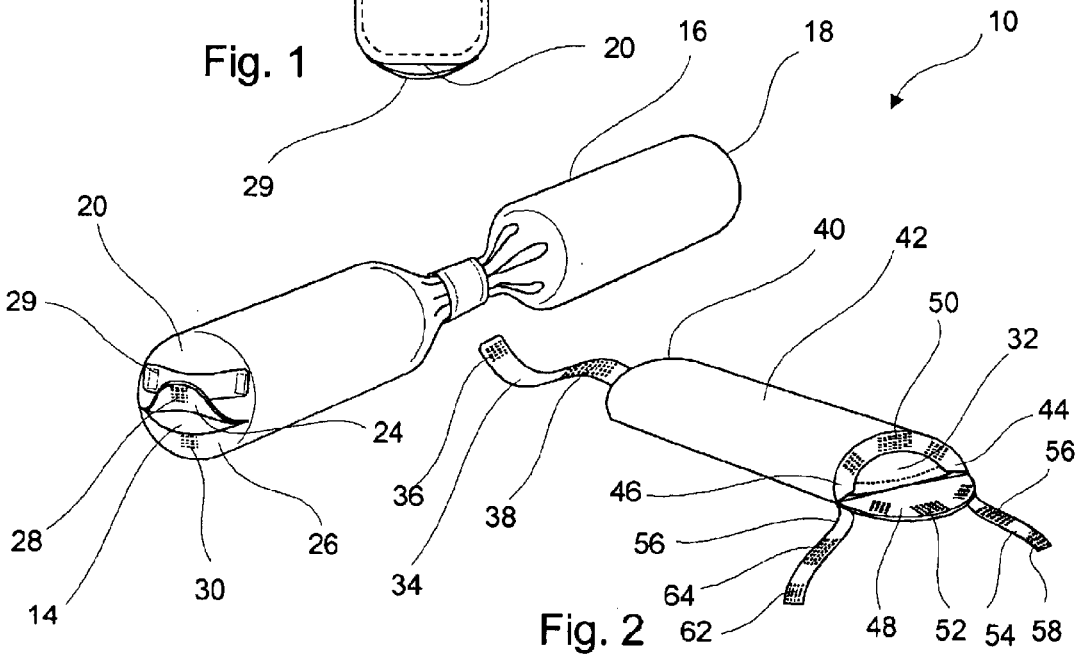
FIG. 2 is a perspective view which illustrates disconnected parts of the therapeutic pillow combination shown in FIG. 1.
Figure 3:
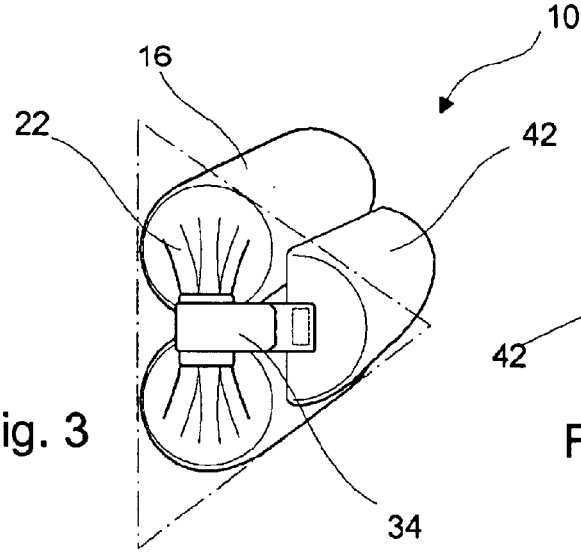
FIG. 3 is another end perspective view which illustrates the therapeutic pillow combination shown in FIG. 1 in a side by side parallel closed position.
Figure 4:
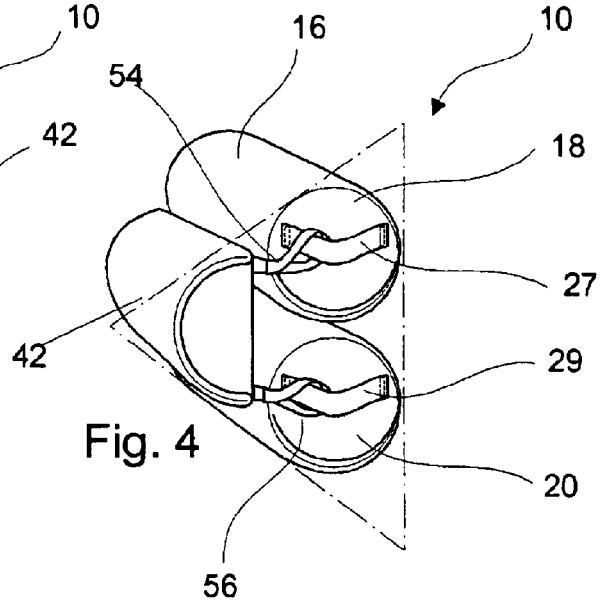
FIG. 4 is yet another end perspective view which illustrates the therapeutic pillow combination shown in FIG. 1 in a side by side parallel closed position.

The ends 18 and 20 are connected by a gathered and seamed portion 22 of the pillow case 16 which forms a handle between the ends 18 and 20. The interconnected pillow inserts 12 and 14 can be aligned in a collinear manner at 180 degrees as seen in FIGS. 1, 2 and 8 or articulated to a side by side parallel position as seen in FIGS. 3–7 and 9. The ends 18 and 20 of the pillow case 16 are configured with overlapping end portions, for example, 24 and 26 (not shown for end 18 but understood to be included as the same) having complementary hook and loop fasteners 28 and 30 to permit insertion and retention of the respective pillow insert 12 and 14 therein. The ends 18 and 20 are also provided with tie straps 27 and 29, respectively, which are stitched thereto.

In addition, another pillow insert 32 is removably connected to the gathered handle portion 22 by way of a strap portion 34 having a hook and loop fasteners 36 and 38, the strap portion 34 is connected to one end 40 of a pillow case 42. The third pillow insert 32 is removably retained in the pillow case 42. The third pillow insert 32 also is preferably elongated and has a rounded side portion in the form of generally hemi-cylindrical, oval cylindrical or cylindrical shape as seen in FIG. 1. Another end 44 has overlapping end portions 46 and 48 with a hook and loop fasteners 50 and 52 used to contain the third pillow insert 32. The end 44 includes a pair of securing straps 54 and 56 which are stitched to the end 44 and have a hook and loop fastener 58 and 60 and 62 and 64, respectively. Straps 54 and 56 can be used to secure to straps 27 and 29 to maintain a desired configuration, as in FIG. 4 for example.

When the pillow inserts are within the pillow cases, respective pillows are formed. In one configuration, the pillows are so connected form a T-shape, wherein the first pillow serves as an arm support for a person lying on one's side, while the second pillow serves to support between the legs and the third pillow is generally perpendicular to the first and second pillows and serves as a support under the waist lumbar area. In another configuration, the pillows are so connected to be in a side by side parallel form, with the handle forming a connecting point for all pillows wherein the pillows can be stacked and disposed against a corner surface support having a generally triangular side profile to serve as a back support for a person. The pillows are spatially connected in a manner such that they can be used for leg, back arm or stomach support, yet easily transported by one hand with grasping of the gathered handle. Further, the stacked pillows provide an aesthetically pleasing pillow arrangement which can be used on one's bed without appearing awkward or overbearing in association with other sleeping and or ornamental pillows used thereon.

Preferably, the pillow inserts 12, 14 and 32 are substantially the same length. However, the present invention envisions that the pillow inserts 12, 14 and 32 could have different lengths to achieve another desired aesthetic or orthopedic feature.

With respect to the specific diameter of the pillow inserts 12, 14 and 32, it should be well understood that the diameter may be adjusted without departing from the scope of the present invention. For the pillow inserts 12, 14, it has been found that a diameter of approximately 7 inches, i.e., a radius of 3.5 inches, provides particularly good support for their intended use whereas the pillow inserts 32 that a diameter of approximately 4 inches, i.e., a radius of 2 inches provides particularly good support for its intended use.

A suitable type of material to form the pillow cases 16 and 42 can be poly cotton or polar fleece, for example. Furthermore, the pillow inserts 12, 14 and 32 can preferably be made of a polyfoam material or the like to perform the intended function. Alternatively, one or more of the pillow inserts 12, 14 and 32 may comprise a bean bag like material, i.e., small round or oval balls made out of plastic or wood, dried beans, or the like. This would provide an additional therapeutic effect which can improve air circulation through the cushion.

Figure 5:
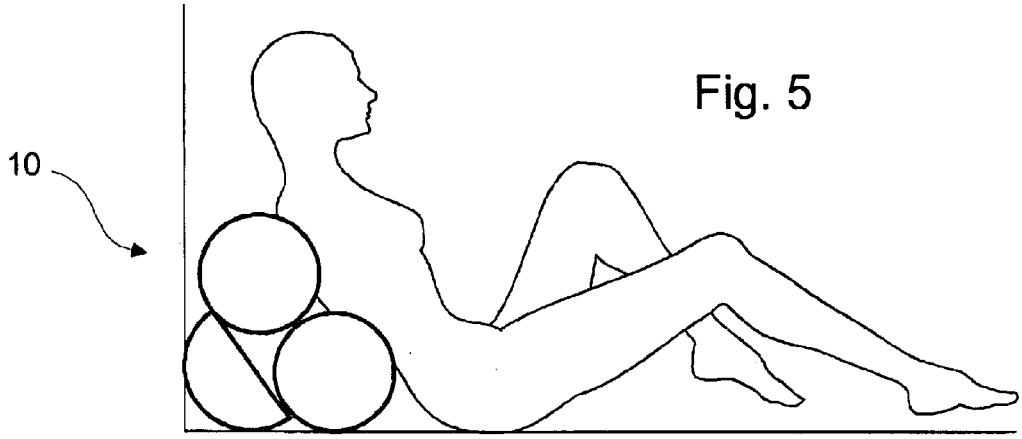
FIG. 5 is a side view which illustrates a use of the therapeutic pillow combination shown in FIG. 1.
Figure 6:
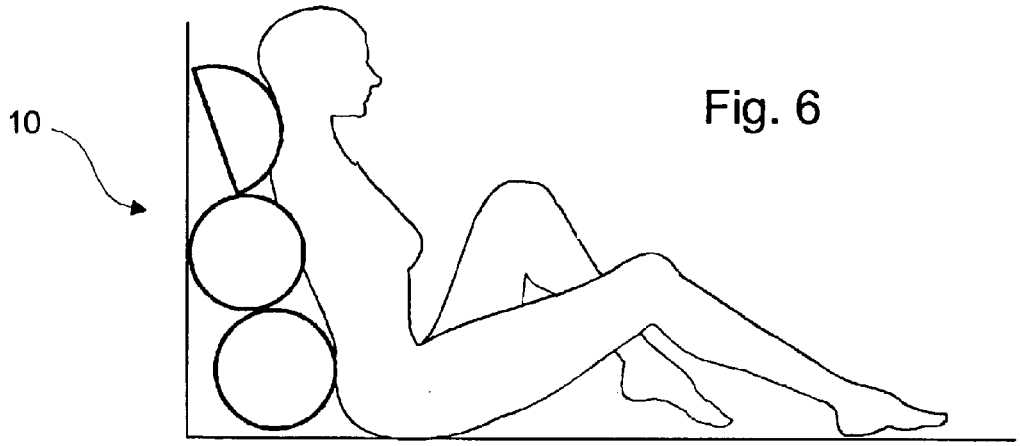
FIG. 6 is a side view which illustrates another use of the therapeutic pillow combination shown in FIG. 1.

Referring to FIGS. 5, 6 and 8, the therapeutic pillow combination 10 can be used in the connected manner, wherein FIGS. 5 and 6 show the use as a back support with FIG. 6 also showing insert 32 used as a neck support and FIG. 8 shows the inserts 12 and 14 used as arm and leg supports with insert 32 used as the waist lumbar support.

FIGS. 7 and 9 show the use of the therapeutic pillow combination 10 with the insert 32 disconnected from the inserts 12 and 14. Here, the inserts 12 and 14 serve as support for the legs and the insert 32 as support for the lumbar area of the back.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A therapeutic pillow combination, comprising:

a first pillow insert;

a second pillow insert;

a first pillow case having a two ends, wherein a first end is shaped to removably receive and retain said first pillow insert through a first closable end portion and a second end is shaped to removably receive and retain said second pillow insert through a second closable end portion, wherein said ends are connected by a gathered and seamed portion forming a handle therebetween, and wherein said first and second pillow inserts can be aligned in a collinear manner at 180 degrees when so retained in said ends and articulated to a side by side parallel position;

a third pillow insert; and a second pillow case having a strap portion connected to a first end and having a hook and loop fastener which is removably connected about said gathered handle portion, and said second pillow case removably receives said third pillow insert through a third closable end portion.

2. A therapeutic pillow combination as recited in claim 1, wherein each said pillow insert is elongated having a rounded side portion.

3. A therapeutic pillow combination as recited in claim 1, wherein said closable end portions are configured with overlapping end portions having complementary hook and loop fasteners to permit insertion and retention of each said pillow insert therein.

4. A therapeutic pillow combination as recited in claim 1, wherein said combination forms a T-shape with said first and second pillow inserts lying generally collinear and wherein said first pillow insert serves as an arm support for a person lying on one's side, said second pillow insert serves as a support between legs of such person and said third pillow insert is generally perpendicular to and between said first and second pillow inserts and serves as a support under a waist lumbar area of such person.

5. A therapeutic pillow combination as recited in claim 1, wherein said pillow inserts are connected in a side by side parallel form with said handle forming a connecting point to maintain said pillow inserts in stacked relation having a generally triangular side profile which can serve as a back support for a person.

6. A therapeutic pillow combination as recited in claim 5, wherein said therapeutic pillow combination provides an aesthetically pleasing pillow arrangement.

7. A therapeutic pillow combination as recited in claim 5, wherein said pillow case ends are interconnected to aid in maintaining said staked relation.

* * * * *